US011728577B2

(12) United States Patent
Haziza

(10) Patent No.: US 11,728,577 B2
(45) Date of Patent: Aug. 15, 2023

(54) MULTI-LAYERED ANTENNA HAVING DUAL-BAND PATCH

(71) Applicants: WAFER LLC, Hanover, NH (US); SDEROTECH, INC., Wilmington, DE (US)

(72) Inventor: Dedi David Haziza, Kiryat Motzkin (IL)

(73) Assignees: WAFER LLC, Hanover, NH (US); SDEROTECH, INC., Wilmington, DE (US)

( * ) Notice: Subject to any disclaimer, the term of this patent is extended or adjusted under 35 U.S.C. 154(b) by 214 days.

(21) Appl. No.: 17/092,618

(22) Filed: Nov. 9, 2020

(65) Prior Publication Data

US 2021/0151900 A1 May 20, 2021

Related U.S. Application Data

(60) Provisional application No. 62/936,283, filed on Nov. 15, 2019.

(51) Int. Cl.

| | |
|---|---|
| ***H01Q 21/06*** | (2006.01) |
| ***H01Q 5/342*** | (2015.01) |
| ***H01Q 5/392*** | (2015.01) |
| ***H01Q 1/38*** | (2006.01) |

(52) U.S. Cl.

CPC ..... *H01Q 21/065* (2013.01); *H01Q 1/38* (2013.01); *H01Q 5/342* (2015.01); *H01Q 5/392* (2015.01)

(58) Field of Classification Search

CPC ..... H01Q 21/065; H01Q 1/38; H01Q 5/342; H01Q 5/392; H01Q 3/44; H01Q 5/35; H01Q 9/0414; H01Q 9/0457; H01Q 21/00; H01Q 1/36; H01Q 1/48; H01Q 1/50; H01Q 21/0006; H01Q 9/0407; H01Q 13/08; H01Q 19/005

See application file for complete search history.

(56) References Cited

U.S. PATENT DOCUMENTS

| | | | | |
|---|---|---|---|---|
| 7,466,269 | B2 | 12/2008 | Haziza | |
| 2006/0097924 | A1* | 5/2006 | Yegin | H01Q 5/378 343/700 MS |
| 2009/0231207 | A1 | 9/2009 | De Vita | |

(Continued)

FOREIGN PATENT DOCUMENTS

| | | | |
|---|---|---|---|
| CN | 106887682 | A | 6/2017 |
| GB | 2445592 | A | 7/2008 |

*Primary Examiner* — David E Lotter

(74) *Attorney, Agent, or Firm* — Womble Bond Dickinson (US) LLP; Joseph Bach, Esq.

(57) ABSTRACT

An array antenna is provided with a plurality of radiating patches, wherein each of the patches, operates in one frequency band along one direction and in a different frequency band along a second direction orthogonal to the first direction. The signals from each radiating patch are coupled to two delay lines, which traverse over a variable dielectric constant plate. A voltage potential is controllably applied to each delay line to change the dielectric constant of the VDC plate in the vicinity of that delay line, thereby introducing delay in signal travel. In order to isolate the voltage potential from the two orthogonal delay lines applied to each radiating patch, at least one of the delay lines is connected to a coupling patch, which capacitively couples the RF energy to the radiating patch.

20 Claims, 7 Drawing Sheets

(56) References Cited

U.S. PATENT DOCUMENTS

| | | | | |
|---|---|---|---|---|
| 2014/0266897 | A1* | 9/2014 | Jakoby | H01Q 3/44 29/601 |
| 2018/0062266 | A1* | 3/2018 | Haziza | H01Q 9/145 |
| 2018/0159213 | A1* | 6/2018 | Haziza | H01Q 1/38 |
| 2018/0159239 | A1* | 6/2018 | Wyler | H01Q 3/44 |
| 2019/0131719 | A1* | 5/2019 | Haziza | H01Q 3/44 |
| 2019/0296429 | A1 | 9/2019 | Haziza | |
| 2020/0112102 | A1* | 4/2020 | Haziza | H01Q 1/48 |

* cited by examiner

MULTI-LAYERED ANTENNA HAVING DUAL-BAND PATCH

RELATED APPLICATIONS

This application claims priority from U.S. Provisional Application No. 62/936,283, filed Nov. 15, 2019, the disclosures of which is incorporated herein by reference in its entirety.

BACKGROUND

1. Field

The disclosed invention relates to radio-transmission antennas and methods for manufacturing such antennas.

2. Related Art

In a prior disclosure, the subject inventor has disclosed an antenna that utilizes variable dielectric constant to control the characteristics of the antenna. Details about that antenna can be found in U.S. Pat. No. 7,466,269, the entire disclosure of which is incorporated herein by reference. In prior disclosures the subject inventor has detailed how the array antenna may be steered or scanned using software control to change the dielectric constant of domains in the vicinity of each delay line independently. The current disclosure implements similar steering/scanning mechanism, but enables the software control to be implemented in an antenna transmitting and receiving at different frequency bands.

SUMMARY

The following summary of the disclosure is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

This disclosure provides various enhancements and advancement for the variable dielectric constant antenna, which provides an improved array antenna and method for manufacturing such an array antenna.

Embodiments of the invention provide a software defined antenna by using a variable dielectric to control a delay line, thereby generating a phase shift for spatial orientation of the antenna. Disclosed embodiments decouple the antenna and the corporate feed design. Disclosed embodiments further decouple the RF and DC potentials from the orthogonal delay lines. The various elements of the antenna, such as the radiator, the corporate feed, the variable dielectric, the phase shift control lines, etc., are provided in different layers of a multi-layered antenna design.

Various disclosed features include arrangement for coupling the RF signal between the radiating element and the feed line; an arrangement for dual-frequency bands for transmission and reception; and an arrangement for increased bandwidth; and methods of manufacturing the antenna.

BRIEF DESCRIPTION OF THE DRAWINGS

Other aspects and features of the invention would be apparent from the detailed description, which is made with reference to the following drawings. It should be appreciated that the detailed description and the drawings provides various non-limiting examples of various embodiments of the invention, which is defined by the appended claims.

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

DETAILED DESCRIPTION

Embodiments of the array antenna will now be described with reference to the drawings. Different embodiments or their combinations may be used for different applications or to achieve different benefits. Depending on the outcome sought to be achieved, different features disclosed herein may be utilized partially or to their fullest, alone or in combination with other features, balancing advantages with requirements and constraints. Therefore, certain benefits will be highlighted with reference to different embodiments, but are not limited to the disclosed embodiments. That is, the features disclosed herein are not limited to the embodiment within which they are described, but may be "mixed and matched" with other features and incorporated in other embodiments.

Figure 1:
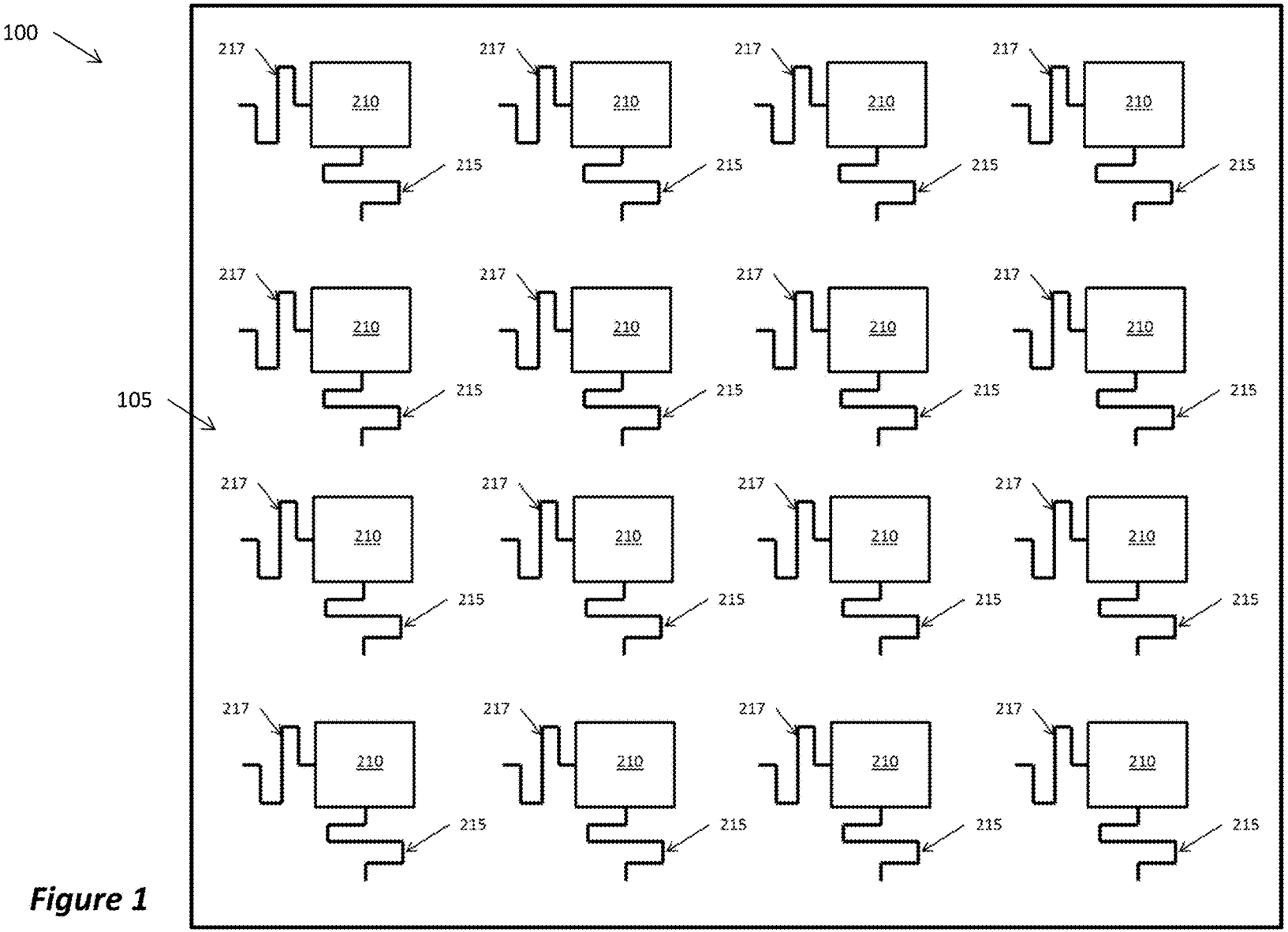
FIG. 1 is a top view illustrating an array according to disclosed embodiment.

FIG. 1 illustrates a top view of an embodiment of an antenna 100. Generally, the antenna is a multi-layer printed antenna, that includes the patch layers, the true time delay layer, the ground layer and the corporate feed layer, as will be described in more details below. In some instances, additional layers are added, providing multiple polarization, wider bandwidth, etc.

As illustrated in FIG. 1, the array antenna 100 in this particular example comprises a 4×4 array of parasitic radiators 210, although any number of radiators may be used and 4×4 is chosen only as one example. Each parasitic radiator 210 is provided on top of an insulation layer 105, over a corresponding dual-band patch, which is not seen in this view as it is obscured by the parasitic radiators 210. The dual-band patch has two delay feed lines 215 and 217 coupled to it, either physically or capacitively, as will be explained further below. Each delay feed line 215, 217 provides the RF signal to its corresponding dual-band patch, which couples the radiation energy to the parasitic radiator 210. The RF signal can be manipulated, e.g., delayed, frequency changed, phase changed, by controlling a variable dielectric layer. By controlling all of the delay lines 215 and 217, the array can be made to point to different directions or scanned, as needed, thus providing a scanning array. Incidentally, while the delay lines are shown in FIG. 1, this is done only to improve understanding and normally may not be seen in this top view as they will be covered by dielectric 105.

Figure 2A:
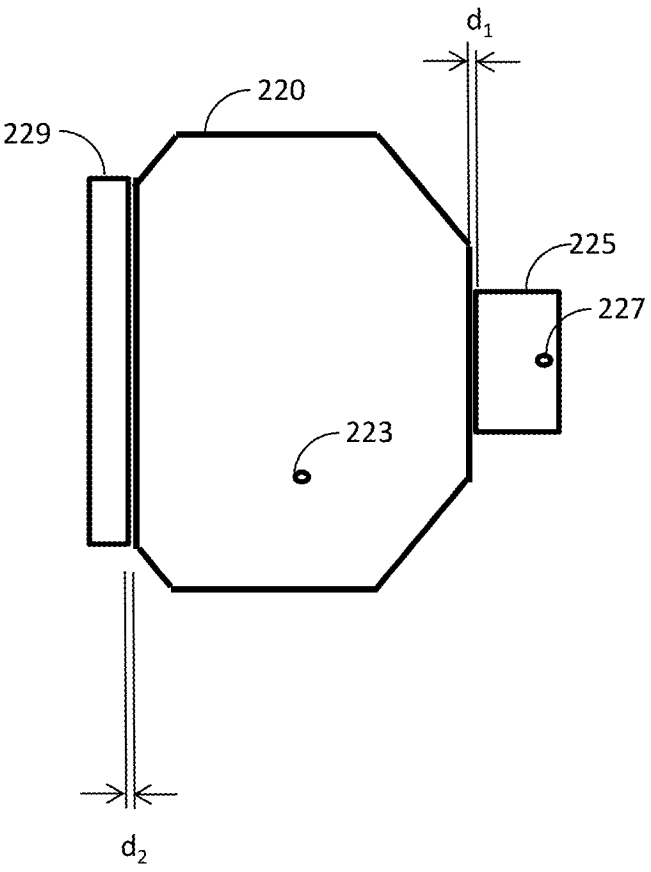
FIG. 2A illustrates another embodiment of the dual-band patch arrangement.
Figure 2:
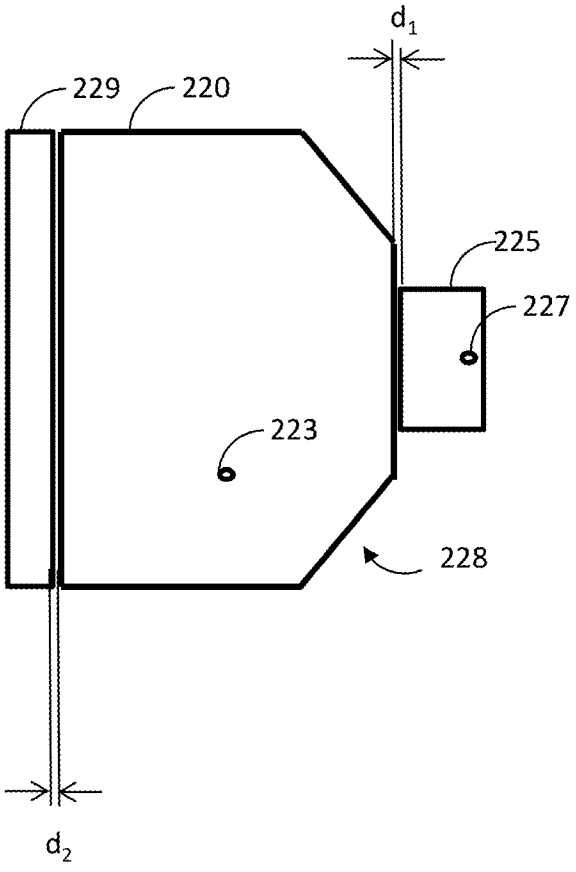
FIG. 2 is a top view illustrating one element of an array antenna according to an embodiment.

FIG. 2 illustrates the arrangement of the dual-band patch 220, which is covered from view by the parasitic radiator 210 in FIG. 1 (one patch 220 under each parasitic radiator 210). Patch 220 is configured to transmit and receive at two different bandwidths, orthogonally. That is, one of the delay lines 215 and 217 would be dedicated to transmission, while the other for reception, and the transmission and reception signals travel in the patch orthogonally to each other. Thus, each delay line would transmit a signal of different frequency selected from a different bandwidth. This is done by coupling the delay lines to a bias-t. However, for efficient use of a bias-t, the design of this patch is such that there is no galvanic connection between the two delay lines at the patch. This is done as follows.

One delay line, e.g., reception at the lower frequency, is connected to the patch via Ohmic contact, while the other delay line, e.g., the transmission at the higher frequency, is coupled to the patch via capacitive coupling having no Ohmic connection. In FIG. 2 this is illustrated as follows. The transmission delay line is connected to the patch 220 from below at contact point 223. As the delay line is formed on a lower layer, it is connected to contact point 223 using a via, as will be shown in FIG. 3. Conversely, the other delay line is connected to contact point 227, which is provided on coupling patch 225. Coupling patch 225 forms a capacitor with patch 220 over separation $d_1$, thus enabling transmission of the RF signal between patches 220 and 225, but preventing passage of DC current there-between.

An optional feature that is also illustrated in FIG. 2 is an LC (inductive-capacitive) circuit attached to the radiating patch in order to increase the bandwidth. The LC circuit is formed by adding proximity patch 229, also may be referred to as capacitive patch, at a separation $d_2$, wherein the separation $d_2$ defines the capacitive portion of the LC circuit and the patch itself forms the inductive portion of the LC circuit at the selected frequency.

Figure 3A:
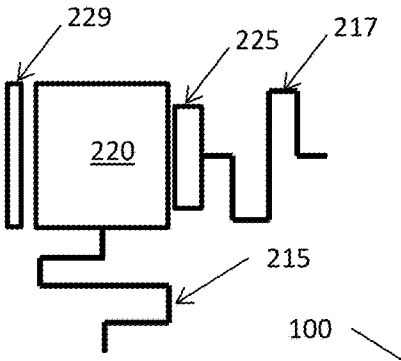
FIG. 3A is a top view and FIG. 3B is a cross section of a structure of a multi-layered array antenna according to an embodiment.
Figure 3B:
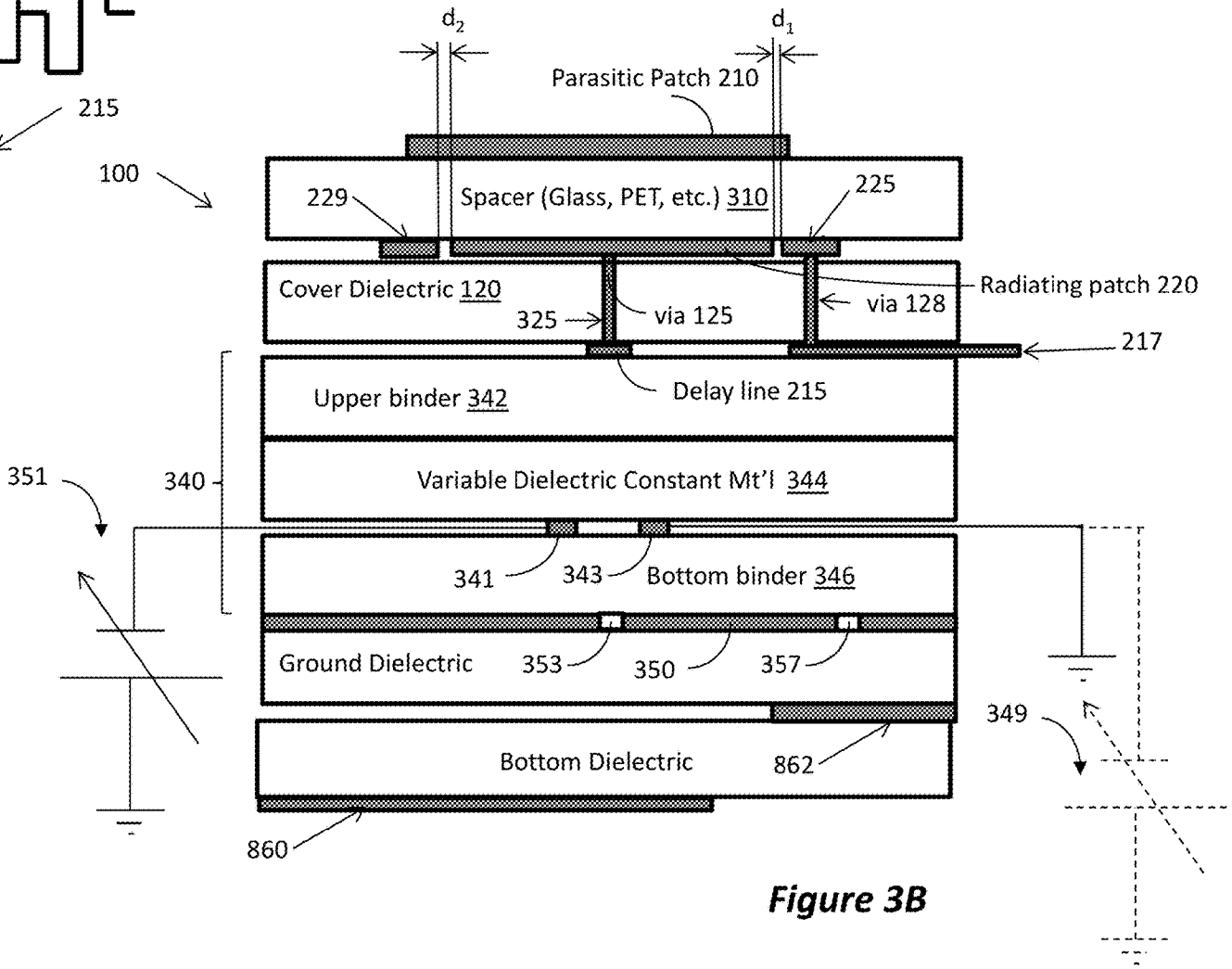
Figure 4:
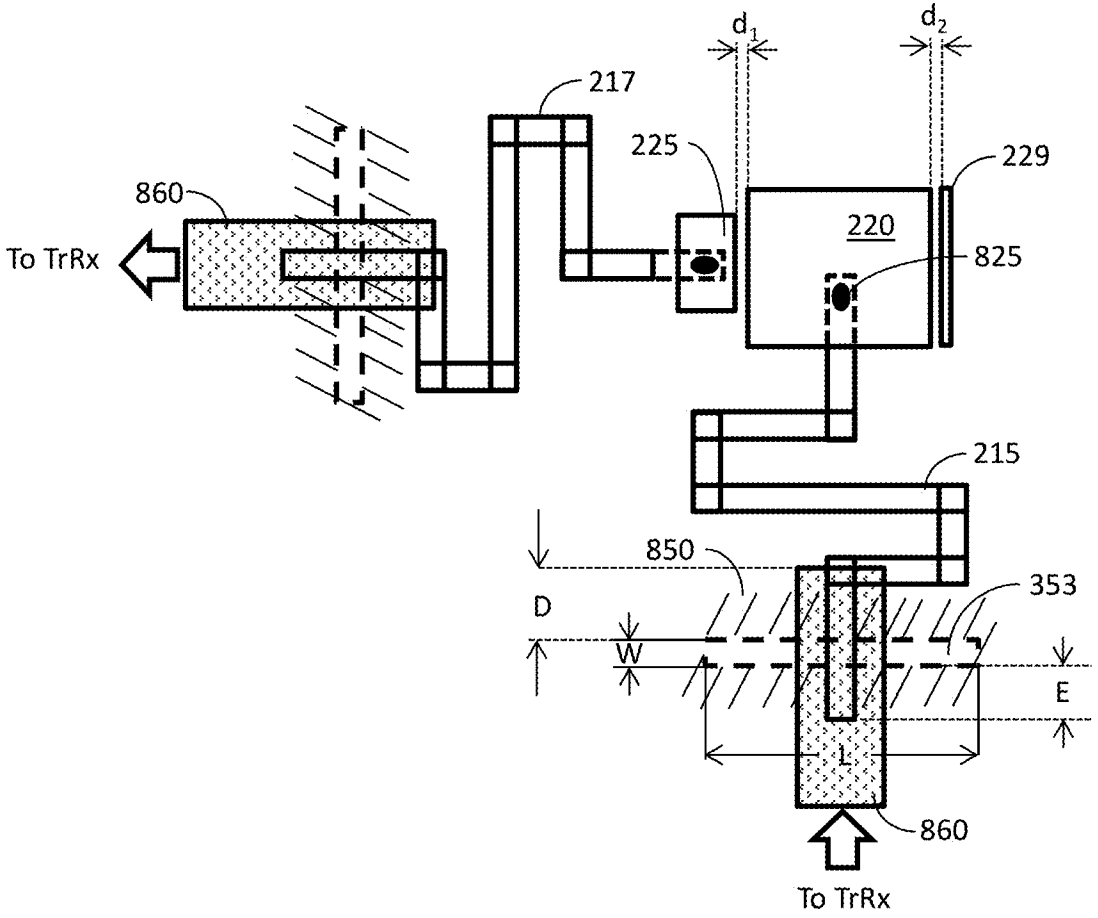
FIG. 4 is a top "transparent" view illustrating a structure of a dual-bands array antenna.

The structure and operation of the antennas shown in FIGS. 1 and 2 can be better understood from the following description of FIGS. 3A and 3B, with further reference to FIG. 4. FIG. 3A illustrates a top view of a single patch 220, while FIG. 3B illustrates a cross section of relevant sections of the antenna at the location of the patch 220 of FIG. 3A. FIG. 4 provides a top "transparent" view that is applicable to the embodiments described herein, including the embodiment of FIGS. 3A and 3B. Thus, in studying any of the embodiments disclosed herein, the reader should also refer to FIG. 4 for a better understanding.

The parasitic radiator 210 is formed over a dielectric spacer 310, which may be glass, PET (polyethylene terephthalate), etc. At each patch location of parasitic radiator 210 a radiating patch 220 is formed in alignment below the parasitic radiator 210. The parasitic radiator 210 has larger lateral dimensions than the radiating patch 220 so as to increase the bandwidth, but may have the same general shape as radiating patch 220. The RF energy is coupled between parasitic radiator 210 and radiating patch 220. Thus, when radiating patch 220 radiates RF energy, it is coupled to the parasitic patch 210 and is then radiating to the ambient from the parasitic radiator 210. Conversely, when parasitic radiator 210 receives RF signal, it couples the signal to the radiating patch 220, which is then sent to the transceiver (not shown) via coupling patch 225 and delay line 217.

With further reference to FIG. 3B, a via 125 is formed and is filled with conductive material, e.g., copper, to form contact 325, which connects physically and electrically, i.e., forming Ohmic contact, to radiating patch 220. One delay line, e.g., 215 is formed on the bottom surface of dielectric spacer, and is connected physically and electrically to contact 325. That is, there is a continuous DC electrical connection from the delay line 215 to radiating patch 220. As shown in FIG. 3A, the delay line is a meandering conductive line and may take on any shape so as to have sufficient length to generate the desired delay, thereby causing the desired phase shift in the signal.

The delay in the delay lines 215 and 217 is controlled by the variable dielectric constant (VDC) plate 340, in this example consisting of upper binder 342, (e.g., glass PET, etc.) variable dielectric constant material 344 (e.g., twisted nematic liquid crystal layer), and bottom binder 346. The dielectric constant of VDC plate 340 can be controlled by applying DC potential across the VDC plate 340. For applying the DC potential, in this example electrodes 341 and 343 are formed and are connected to controllable voltage potential 351, e.g., a pulse-width modulated DC supplier. There are various arrangements to form the electrode, and one example is shown but any conventional arrangement for applying DC potential to a VDC is workable.

As one example, electrode 341 is shown connected to variable potential 351, while electrode 343 is connected to ground. As one alternative, as shown in broken line, electrode 343 may also be connected to a variable potential 349. Thus, by changing the output voltage of variable potential 351 and/or variable potential 349, one can change the dielectric constant of the VDC material in the vicinity of the electrodes 341 and 343, and thereby change the RF signal traveling over delay line 215.

At this point it should be clarified that in the subject description the use of the term ground refers to both the generally acceptable ground potential, i.e., earth potential, and also to a common or reference potential, which may be a set potential or a floating potential. Similarly, while in the drawings the symbol for ground is used, it is used as shorthand to signify either an earth or a common potential, interchangeably. Thus, whenever the term ground is used herein, the term common or reference potential, which may be a set positive or negative potential or a floating potential, is included therein.

The second delay line, 217 is physically and electrically connected to capacitive patch 225 by via 128. Another set of electrodes are used to apply voltage potential to the LC in the vicinity of delay line 217, but is not shown in the Figure as it is physically beyond the section illustrated in FIG. 3B. The inductive/capacitive LC patch 229 is not physically or Ohmically connected to anything and electrically floats, forming an LC circuit with radiating patch 220.

As with all RF antennas, reception and transmission are symmetrical, such that a description of one equally applies to the other. In this description it may be easier to explain transmission, but reception would be the same, just in the opposite direction.

In transmission mode the RF signal travels from the transceiver to the feed line 860, from which it is capacitively coupled to the delay line 215 and from there to the radiating patch 220 through via 125, to the parasitic radiator 210, and then to the atmosphere. In reception, the signal received by the parasitic radiator 210 is coupled to the radiating patch 220, from there it is coupled to the coupling patch 225, from there to the delay line 217, and from there to the transceiver through feed line 862. In the example illustrated, some of the signal coupling is done via Ohmic contact, while others via capacitive coupling, as follows.

As shown in the example of FIG. 3B, there is no electrical DC (Ohmic) connection between the feed lines 860/862 and the respective delay lines 215/217. Rather, in this example an RF short is provided such that the RF signal is capacitively coupled across a window formed in the ground plane. As illustrated in FIG. 3B, a window 353 is provided in the back plane ground (or common) 350 and is aligned below a first end of the delay line 215 (the other end is connected to contact 325). The RF signal travels from the feed line 860, via the window 353, and is capacitively coupled to the delay line 215. Similarly, a window 357 is provided in the ground plane 350 and is aligned below a first end of the delay line 217 (the other end is connected to via 128). During reception the signal from delay line 217 is capacitively coupled to the feed line 862 through window 357.

To further understand the RF short (also referred to as virtual choke) design of the disclosed embodiments, reference is made to FIG. 4. For the transmission side of FIG. 4 the radiating patch 220 is electrically connected to the delay line 215 by contact 825. As shown in FIG. 3B, the VDC plate 340 is positioned below the delay line 215, but in FIG. 4 it is not shown, so as to simplify the drawing for better understanding of the RF short feature. The back plane ground 350 is partially represented by the hatch marks 850, also showing the window 353. For efficient coupling of the RF signal, the length of the window 853, indicated as "L", should be set to about half the wavelength traveling in the feed line 860, i.e., $\lambda/2$. In that respect, every reference to wavelength, $\lambda$, indicates the wavelength in the related medium, as the wavelength may change as it travels in the various media of the antenna according to its design and the DC potential applied to variable dielectric matter within the antenna. The width of the window, indicated as "W", should be set to about a tenth of the wavelength, i.e., $\lambda/10$.

Additionally, for efficient coupling of the RF signal, the feed line 860 extends about a quarter wave, $\lambda/4$, beyond the edge of the window 853, as indicated by D. Similarly, the terminus end (the end opposite contact 825) of delay line 215 extends a quarter wave, $\lambda/4$, beyond the edge of the window 353, as indicated by E. Note that distance D is shown longer than distance E, since the RF signal traveling in feed line 860 has a longer wavelength than the signal traveling in delay line 215.

A similar capacitive coupling arrangement is provided for coupling the received signal from delay line 217 to the feed line 860. Additionally, the signal from the radiating patch is capacitively coupled to the delay line 217 across coupling patch 225. As shown more clearly in FIG. 3B, coupling patch 225 is provided at the same plane as radiating patch 220 and is positioned at a distance $d_1$ from an edge of the radiating patch 220. This arrangement allows for RF signal to be transmitted between the radiating patch 220 and coupling patch 225, but prevents transmission of a DC signal between the radiating patch 220 and coupling patch 225. This arrangement enables the received signal to operate at a different frequency than the transmit signal without interference during control of the VDC plate. Also, since the operation in transmit and receive are at different frequencies, and are received at the radiating patch orthogonal to each other, the radiating patch is not square, but rather is more of a rectangular, wherein the radiating patch has a length and width that are different from each other.

Note that in FIG. 2 the patch is illustrated as having two corners removed on one side, as indicated by 228, thereby forming what sometimes referred to as "pseudo square." Removing the corners in this example is beneficial for at least two reasons. First, it prevents "leakage" of signal among neighboring radiating patch. Having a sharp corner generate high concentration of field and may lead to RF signal leakage. Additionally, one reason the cutout are on the side of the coupling patch 225 is that it enhances the coupling of the RF signal between the radiating patch 220 and the coupling patch 225.

As noted, another feature of this disclosure is the use of an inductive-capacitive LC circuit at the radiating patch to increase the bandwidth. The LC circuit is formed by capacitive or proximity patch 229 positioned at the same plane as the radiating patch and coupling patch 225, at a separation distance $d_2$ from the side of the radiating patch 220, wherein the separation $d_2$ (and the dielectric constant of the substance in the separation) defines the capacitance of the capacitive portion of the LC circuit and the patch itself forms the inductive portion of the LC circuit. Note that the capacitive patch 229 is electrically floating and is insulated from any other conductive part of the array antenna.

FIG. 2A illustrates another embodiment of the dual-band patch arrangement having a similar capacitive coupling of the RF signal as that of FIG. 2, but having a modified LC arrangement. Specifically, the length of the proximity patch 229 need not be the same as that of the radiating patch 220. In the embodiment of FIG. 2A the length of the proximity patch 229 is shorter than that of the radiating patch 220. Additionally, the corners of the radiating patch 220 are removed on the side facing the proximity patch 229 and on the side facing the coupling patch 225. In this respect, the design of radiating patch illustrated in FIG. 2 can be referred to as half-pseudo square, while the design in FIG. 2A as pseudo square, although, as noted, the design is rectangular so it may also be referred to as pseudo-rectangular—meaning a rectangular shape with removed corners. Also, the parasitic patch 210 may have the same shape with removed corners as that of radiating patch 220, except that it may have larger dimensions.

Figure 5:
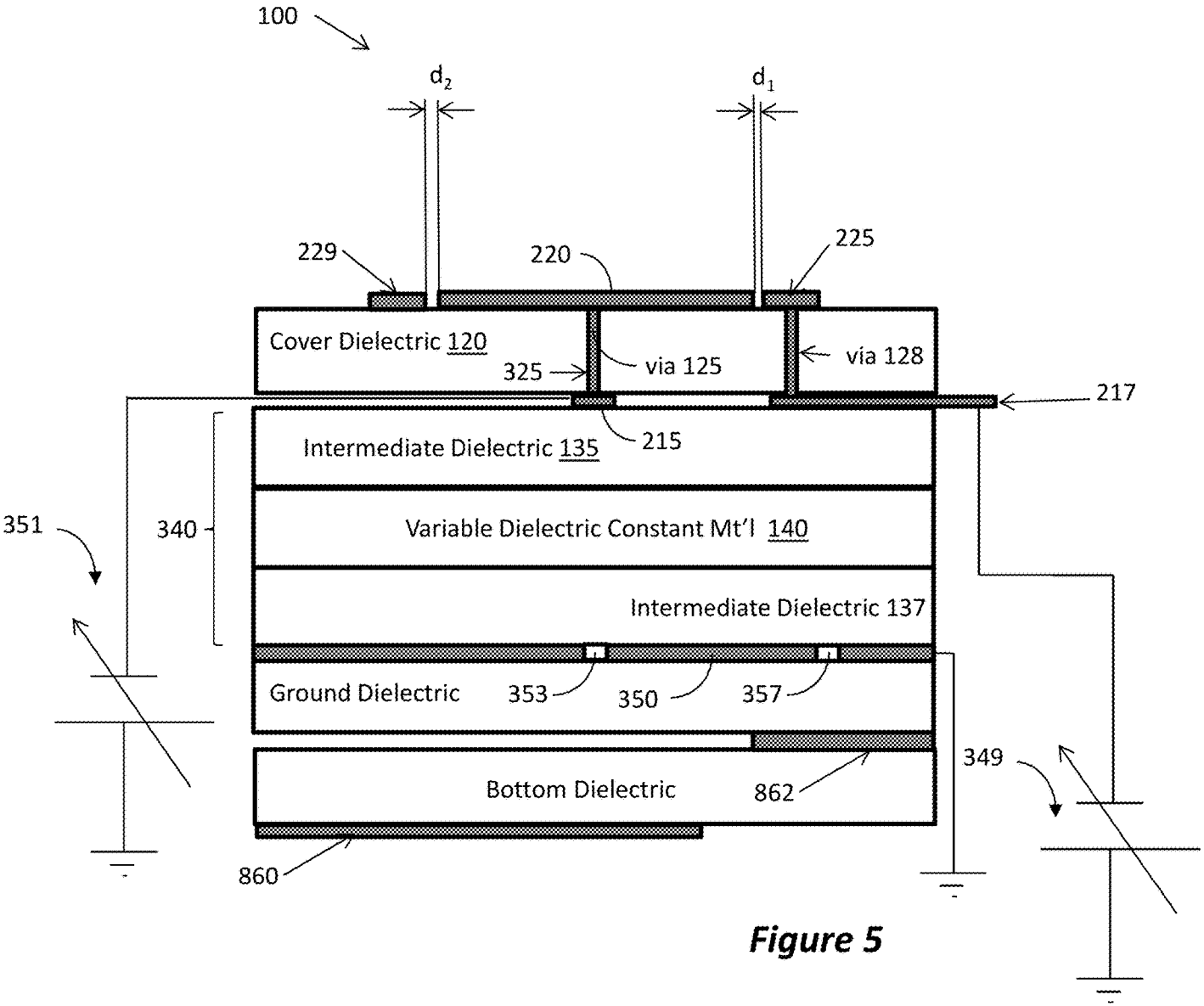
FIG. 5 is a cross-section of a multi-layer array antenna according to another embodiment.

FIG. 5 illustrates an embodiment that benefits immensely from the features disclosed herein, particularly the separation of transmission and reception RF coupling to the radiating patch 220. Specifically, in this embodiment the control voltage from DC power suppliers 351 and 349 are supplied to the delay lines 215 and 217, respectively. Thus, when a DC potential is applied to a delay line, the liquid crystal in the vicinity of that delay line changes its dielectric constant in relation to the applied potential. During operation, the potential applied to delay line 215 is different from the potential applied to delay line 217. Thus, by having one delay line having Ohmic contact to the radiating patch 220 and one delay line having a DC break to the radiating patch 220, DC isolation is created between delay lines 215 and 217, while both delay lines still have RF coupling to the radiating patch 220.

From the explanation above, it should be appreciated that the DC isolation feature is beneficial even when the radiating patch 220 is square, i.e., transmission and reception performed at the same bandwidth. Also, It should be appreciated that the benefit of the disclosed invention can be implemented without using a parasitic radiator, as exemplified by the embodiment of FIG. 5. That is, in FIG. 5 the signal from the radiating patch is radiated directly to the atmosphere, not to the parasitic patch. Of course, the same can be done with the other embodiments disclosed herein. It should also be noted that in the embodiment of FIG. 5 the ground plane 350 functions as ground for all of the RF and DC signals of the antenna.

As indicated, transmission and reception are symmetrical operations. Therefore, it should be understood that while the embodiments were described with delay line 215 used for transmission and delay line 217 used for reception, the roles of these lines can be reversed and delay line 215 used for reception while delay line 217 used for transmission.

Thus, an array antenna is provided, comprising: an insulating substrate; a plurality of radiating patches provided over a top surface of the insulating substrate; a plurality of first vias formed in the insulating substrate, each of the first vias being filled with conductive material and contacting a respective one of the radiating patches; a plurality of capacitive patches provided over the top surface of the insulating substrate, each positioned at a distance d from a respective one of the radiating patches, thereby forming a capacitor with the respective one of the radiating patch; a plurality of second vias formed in the insulating substrate, each of the second vias being filled with conductive material and electrically contacting a respective one of the capacitive patches; a plurality of first delay lines, each connected to a respective one of the first vias; a plurality of first control lines, each connected to a voltage source and to a respective one of the first delay lines; a plurality of second delay lines, each connected to a respective one of the second vias; a plurality of second control lines, each connected to the voltage source and to a respective one of the second delay lines; a variable dielectric constant (VDC) plate provided below the insulating substrate; and, a ground plane provided over a surface of the VDC plate.

Figure 6:
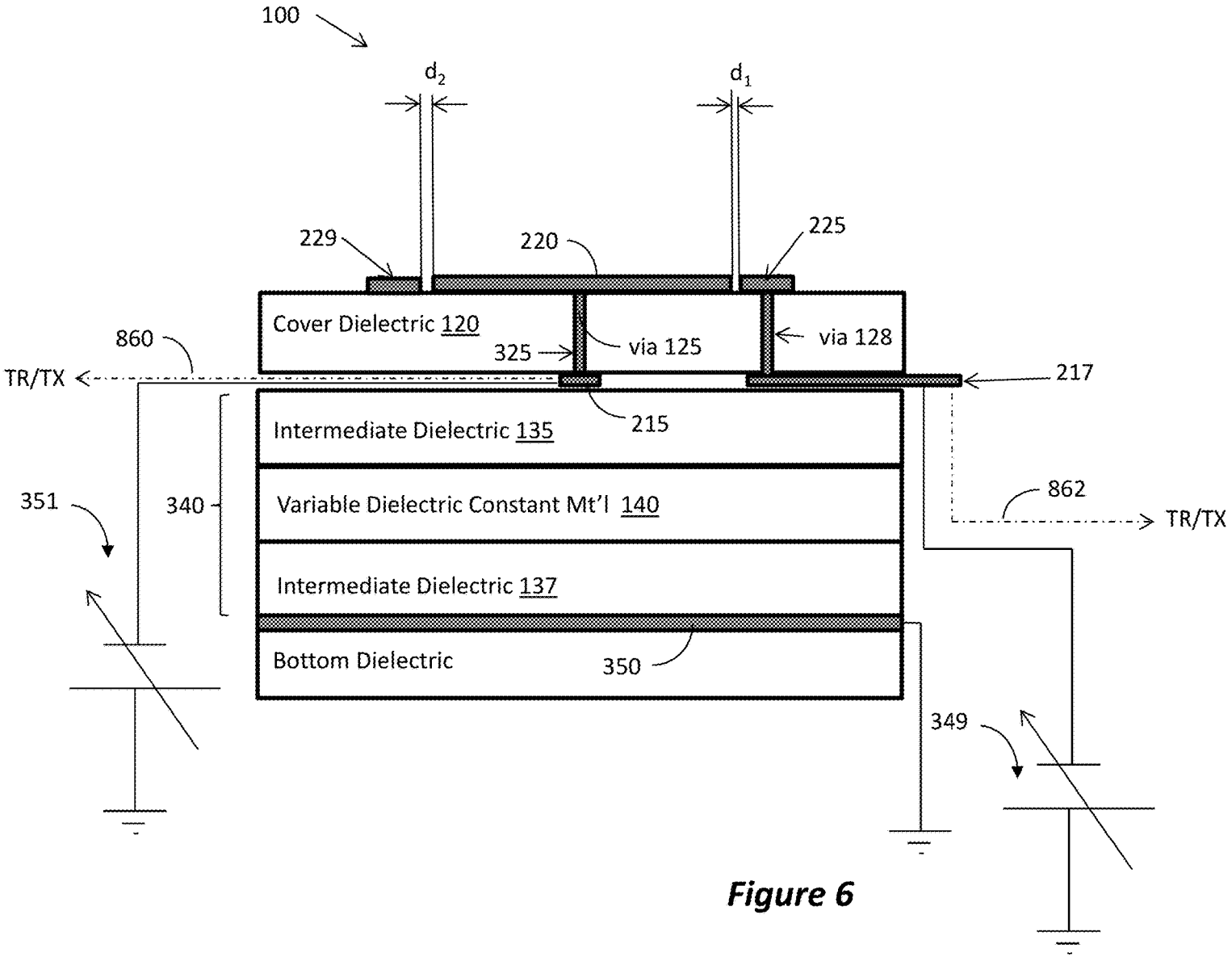
FIG. 6 is a cross-section of a multi-layer array antenna according to yet another embodiment.

FIG. 6 is a cross-section of a multi-layer array antenna according to yet another embodiment. In the embodiment of FIG. 6 the feed lines 860 and 862 are directly connected to the delay lines 215 and 217, respectively. It should be appreciated that the connections may be made in a plane perpendicular to the page, which is one reason the feed lines are shown as dash-dot lines. Since the feed lines are connected directly to the delay lines, the ground plane 350 need not have the windows for capacitive coupling of the RF signal.

Figure 7:
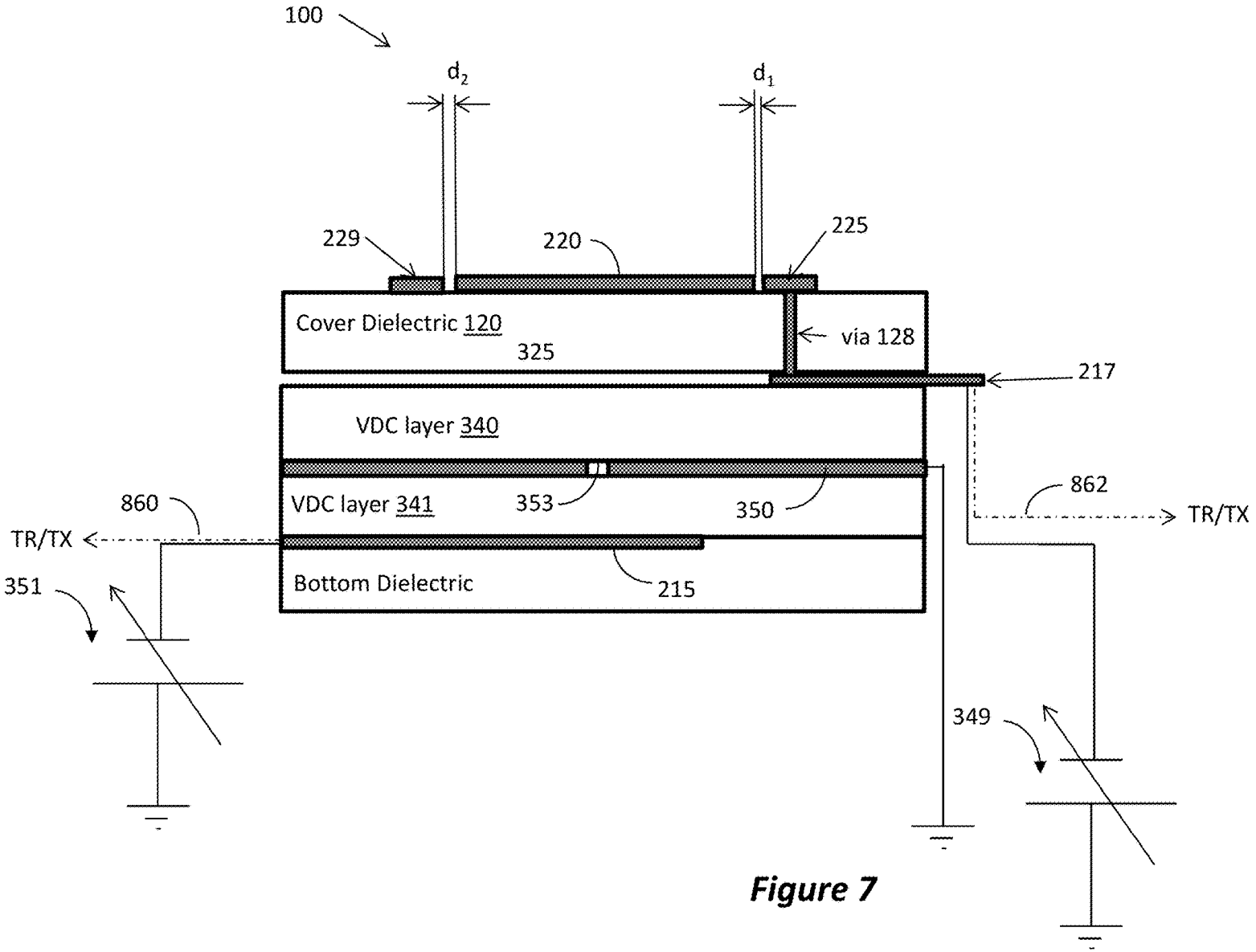
FIG. 7 is a cross-section of a multi-layer array antenna according to a further embodiment.

FIG. 7 is a cross-section of a multi-layer array antenna according to a further embodiment. In the embodiment of FIG. 7 the RF signal of delay line 217 is capacitively coupled to the radiating patch 220 via the coupling patch 225, while the RF signal of delay line 215 is capacitively coupled to the radiating patch 220 via the window 353 in the ground plane 350. Thus, a complete isolation is provided between the delay lines 215 and 217. Moreover, the control signal from voltage supply 349 affects the domains of VDC layer 340 in the vicinity of delay line 217, while the control signal from voltage supply 351 affects the domains of VDC layer 341 in the vicinity of delay line 215. The ground plane 350 provides isolation between the VDC layers 340 and 341. Additionally, since each of delay lines 215 and 217 is in a different layer, there is more "real estate" or space available to make the meandering delay lines as long as desired and in any shape desired. Incidentally, the alignment of the delay line 215 to window 353 may be designed similarly to that explained with respect to FIG. 4.

Thus, an array antenna is provided, comprising: a dielectric substrate; a plurality of radiating patches provided over the dielectric substrate; a plurality of coupling patches provided over the dielectric substrate, each of the coupling patches abating at a distance d a corresponding one of the radiating patches; a ground plane sandwiched between a first variable dielectric constant (VDC) layer and a second VDC layer, the ground plane having a plurality of windows, each aligned below one of the plurality of radiating patches; a plurality of first delay lines, each having an Ohmic contact to one of the coupling patches; and a plurality of second delay lines, each having a terminus end aligned with one of the plurality of windows and configured to capacitively couple RF energy to one of the radiating patches. The Ohmic contact may comprise a plurality of conductive vias formed in the dielectric substrate, each connecting one of the first delay lines to a corresponding one of the coupling patches. The array antenna may further comprise a plurality of proximity patches provided over the dielectric substrate, each abating at a distance d2 a corresponding one of the radiating patches. The array antenna may further comprise a plurality of first control lines, each connected to a voltage source and to a respective one of the plurality of first delay lines; and a plurality of second control lines, each connected to the voltage source and to a respective one of the plurality of second delay lines.

It should be understood that processes and techniques described herein are not inherently related to any particular apparatus and may be implemented by any suitable combination of components. Further, various types of general purpose devices may be used in accordance with the teachings described herein. The present invention has been described in relation to particular examples, which are intended in all respects to be illustrative rather than restrictive. Those skilled in the art will appreciate that many different combinations will be suitable for practicing the present invention.

Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

The invention claimed is:

1. An antenna comprising:

an insulating substrate;

a radiating patch provided over a top surface of the insulating substrate;

a first via formed in the insulating substrate, the first via being filled with conductive material contacting the radiating patch;

a capacitive patch provided over the top surface of the insulating substrate at a distance d from the radiating patch thereby forming a capacitor with the radiating patch;

a second via formed in the insulating substrate, the second via being filled with conductive material electrically contacting the capacitive patch;

a first delay line connected to the first via;

a second delay line connected to the second via;

a variable dielectric constant (VDC) plate;

a ground plane provided over a surface of the VDC plate; and an inductive-capacitive circuit coupled to the radiating patch, wherein the inductive-capacitive circuit comprises an electrically floating patch provided over the top surface of the insulating substrate.

2. The antenna of claim 1, wherein a length of the radiating patch in one direction is longer than in a perpendicular direction.

3. The antenna of claim 1, further comprising at least one additional radiating patch provided over the top surface of the insulating substrate.

4. The antenna of claim 1, wherein the radiating patch has cut corners at a side facing the floating patch.

5. The antenna of claim 4, wherein the electrically floating patch is positioned opposite the capacitive patch at a distance d2 from the radiating patch.

6. The antenna of claim 5, wherein the distance d2 is different from distance d.

7. The antenna of claim 1, further comprising a parasitic patch provided over the radiating patch.

8. The antenna of claim 7, wherein the parasitic patch is larger than the radiating patch.

9. The antenna of claim 1, further comprising a first feed line having terminus end aligned below the first delay line and a second feed line having terminus end aligned below the second feed line, and wherein the ground plane comprises a first window aligned with the terminus end of the first feed line and a second window aligned with the terminus end of the second feed line.

10. An array antenna comprising:

an insulating substrate;

a plurality of radiating patches provided over a top surface of the insulating substrate;

a plurality of first vias formed in the insulating substrate, each of the first vias being filled with conductive material and contacting a respective one of the radiating patches;

a plurality of coupling patches provided over the top surface of the insulating substrate, each positioned at a distance d from a respective one of the radiating patches, thereby forming a capacitor with the respective one of the radiating patch;

a plurality of second vias formed in the insulating substrate, each of the second vias being filled with conductive material and electrically contacting a respective one of the coupling patches;

a plurality of first delay lines, each connected to a respective one of the first vias;

a plurality of first control lines, each connected to a voltage source and to a respective one of the first delay lines;

a plurality of second delay lines, each connected to a respective one of the second vias;

a plurality of second control lines, each connected to the voltage source and to a respective one of the second delay lines;

a plurality of inductive-capacitive (LC) arrangements, each coupled to one of the plurality of radiating patches, wherein each of the plurality of inductive-capacitive arrangements comprises a proximity patch provided over the top surface of the insulating substrate and positioned at a distance d2 from a respective one of the radiating patches;

a variable dielectric constant (VDC) plate provided below the insulating substrate; and a ground plane.

11. The array antenna of claim 10, further comprising:

a plurality of first RF feed lines, each coupling RF energy to a respective one of the plurality of first delay lines; and a plurality of second RF feed lines, each coupling RF energy to a respective one of the plurality of second delay lines.

12. The array antenna of claim 10, wherein the proximity patch is shorter than a side of the corresponding radiating patch.

13. The array antenna of claim 12, wherein the proximity patch is insulated from any other conductive part of the array antenna.

14. The array antenna of claim 10, further comprising a second VDC plate, and wherein the ground plane is sandwiched between the VDC plate and the second VDC plate.

15. The array antenna of claim 11, wherein the ground plane comprises a plurality of windows, each aligned to a terminus end of one of the plurality of first delay lines.

16. The array antenna of claim 10, further comprising a plurality of parasitic patches, each provided over a corresponding one of the plurality of radiating patch, and wherein each of the parasitic patches has the same shape but is of larger dimension than the corresponding radiating patch.

17. The array antenna of claim 16, wherein a length of each of the radiating patches in one direction is longer than in a perpendicular direction.

18. The array antenna of claim 17, wherein each of the radiating patches has a pseudo-rectangular shape.

19. The array antenna of claim 10, wherein each of the proximity patches is electrically DC isolated from the voltage source.

20. The array antenna of claim 10, further comprising:

a plurality of first feed lines, each having terminus end aligned below one of the plurality of first delay lines;

a plurality of second feed lines, each having terminus end aligned below one of the plurality of second feed line; and wherein the ground plane comprises a plurality of first windows, each aligned with the terminus end of one of the first feed lines and a plurality of second windows, each aligned with the terminus end of one of the second feed lines.

* * * * *